US007513195B2

(12) United States Patent
Eckert et al.

(10) Patent No.: US 7,513,195 B2
(45) Date of Patent: Apr. 7, 2009

(54) PRINTING MACHINE COMPRISING AT LEAST ONE PRINTING GROUP, ONE FOLDER AND AT LEAST ONE TURN-AND-MIX STAGE

(75) Inventors: Günther Oskar Eckert, Zellingen (DE); Burkard Otto Herbert, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 479 days.

(21) Appl. No.: 10/543,256

(22) PCT Filed: Dec. 19, 2003

(86) PCT No.: PCT/DE03/04192

§ 371 (c)(1),
(2), (4) Date: Jul. 25, 2005

(87) PCT Pub. No.: WO2004/069708

PCT Pub. Date: Aug. 19, 2004

(65) Prior Publication Data

US 2006/0130682 A1 Jun. 22, 2006

(30) Foreign Application Priority Data

Feb. 4, 2003 (DE) ..... 103 04 295

(51) Int. Cl.
*B41F 13/56* (2006.01)

(52) U.S. Cl. ..... 101/227; 271/5.03; 271/21.1

(58) Field of Classification Search ..... 101/226, 101/227, 228; 270/5.02, 5.03, 18, 19, 20.1, 270/21.1

See application file for complete search history.

(56) References Cited

U.S. PATENT DOCUMENTS

| | | | | |
|---|---|---|---|---|
| 2,506,053 | A * | 5/1950 | Zuckerman | 270/18 |
| 3,255,679 | A * | 6/1966 | Eckels | 493/333 |
| 3,734,487 | A | 5/1973 | Treff | |
| 4,279,184 | A * | 7/1981 | Smolders | 83/302 |
| 4,671,501 | A | 6/1987 | Fujishiro | |

(Continued)

FOREIGN PATENT DOCUMENTS

DE 44 19 217 A1 12/1995

(Continued)

OTHER PUBLICATIONS

Muth, Engelbert, Falzvorrichtungen an Rollen-Tiefdruckmaschinen.

(Continued)

*Primary Examiner*—Ren Yan
(74) *Attorney, Agent, or Firm*—Jones, Tullar & Cooper, P.C.

(57) ABSTRACT

A printing machine includes at least one printing group, one folder and at least one turn-and-mix stage that supplies the printed web output from the printing group to the folder. A web path from the printing group to the folder, when projected into a horizontal plane, is bent or deviates in the area of the turn-and-mix stage. The turn-and-mix stage or superstructure, includes a horizontal cutting device at an input side, for use in cutting the web into at least two partial webs. At least two horizontally displaceable turning bars are provided, and the partial webs pass around these turning bars.

15 Claims, 4 Drawing Sheets

U.S. PATENT DOCUMENTS

| | | | | |
|---|---|---|---|---|
| 5,328,437 | A * | 7/1994 | Maylander et al. | 493/357 |
| 5,413,039 | A | 5/1995 | Sohma | |
| 6,082,259 | A | 7/2000 | Siegenthaler et al. | |
| 6,695,250 | B2 * | 2/2004 | Michalik et al. | 242/615.21 |
| 6,886,823 | B2 | 5/2005 | Herbert | |

FOREIGN PATENT DOCUMENTS

| | | |
|---|---|---|
| DE | 197 28 207 A1 | 1/1999 |
| DE | 101 31 976 A1 | 1/2003 |
| GB | 352003 | 7/1981 |
| JP | 60-0019660 | 1/1985 |

OTHER PUBLICATIONS

Walenski, Wolfgang, Der Rollen Offset druck, 1995.

* cited by examiner

PRINTING MACHINE COMPRISING AT LEAST ONE PRINTING GROUP, ONE FOLDER AND AT LEAST ONE TURN-AND-MIX STAGE

CROSS-REFERENCE TO RELATED APPLICATIONS

This patent application is the U.S. national phase, under 35 USC 371, of PCT/DE 2003/004192, filed Dec. 19, 2003; published as WO 2004/069708 A1 on Aug. 19, 2004, and claiming priority to DE 103 04 295, filed Feb. 4, 2003, the disclosures of which are expressly incorporated herein by reference.

FIELD OF THE INVENTION

The present invention is directed to a printing press with at least one printing group, one folding apparatus and at least one turning and mixing stage. The turning and mixing stage conducts the web from the printing group to the folding apparatus.

BACKGROUND OF THE INVENTION

Single- and double-width printing groups are generally known, and are typically printing groups whose cylinder width is of such dimensions that the cylinders are capable of supporting two or four printing plates side-by-side. If a printing press, with a single-width printing stage, is employed for imprinting a broadsheet product, the imprinted continuous web is then longitudinally folded in the former of the folding apparatus and is subsequently cut into signatures. It is also possible to imprint tabloid products, if a longitudinal cutting device, which severs the imprinted web linearly in the center, is provided between the printing stage and the folding apparatus. In this case, two partial webs are placed on top of each other in the former, are then cut into sections, and a signature is formed only in the course of subsequent transverse folding of the cut-off sections. The change between tabloid and broadsheet production is comparatively simple, even if webs of different widths are being used in both productions. If the webs are conducted through the printing press, and are centered in relation to a center line, the longitudinal cutting device and the nose of the former are always correctly positioned with respect to each other.

Double-width printing stages are capable of imprinting four printed pages positioned side-by-side, which four printed pages are distributed over the width of a web. Before such a double-width web passes through a turning and mixing stage, it must be cut longitudinally at least once, at the center of the web, for forming two partial webs, each of which has a width of two pages. After mixing and, if required, turning, these partial webs are then conducted to formers of a folding apparatus. If such a press is to be capable of processing webs of different widths, it is either necessary to be able to match the position of the formers to the width of the web or, if the former is fixed, the turning and mixing stage must be capable of laterally offsetting the two partial webs by a fraction of their width in such a way that they arrive correctly centered at the formers and the longitudinal fold is thus formed in the right position. If broadsheet products with inserts, or tabloid products, are formed, the partial webs, provided by the first longitudinal cutting device, must be cut again by two longitudinal cutting devices. With changes in the width of the webs, this longitudinal cutting is only correctly possible if at least the second longitudinal cutting devices can be shifted transversely in relation to the web.

Initially, these problems make it appear that it would be sensible to employ printing presses of single width for printing jobs requiring the use of webs of different widths. However, this has the disadvantage that a number of single-width printing groups, which would be required for producing a signature of a given amount of pages, is twice as large as a number of double-width printing groups which would be needed for the same purpose. Two single-width printing groups are clearly more expensive to construct and are therefore also greater in price than a double-width printing group. Added to this is the fact that commercially available double-width printing groups are often constructed for higher web speeds than are single-width printing groups. To construct a single-width printing press of large output capabilities, it is not possible to utilize existing components. Instead, it is necessary to construct such printing groups from scratch.

DE 197 28 207 A1 discloses a printing press with two turning towers which are arranged between two printing towers, which two turning towers redirect the webs, which run transversely, with respect to the cylinder axes of the printing groups, longitudinally in respect to the cylinder axes. The turning towers conduct the webs to a folding apparatus, in which the formers are arranged transversely, with respect to the cylinder axes.

DE 44 19 217 A1 shows a printing press with a longitudinal former. The width of the longitudinal former is approximately that of the width of the printing groups.

It has become known, for example from an article by Engelbert Muth in Polygraph 1965, pages 508 to 512, and entitled "Falzvorrichtungen an Rollentiefdruckmaschinen" [Folding Devices in Web-Fed Rotogravure Printing Presses], to laterally adjust paper webs by shifting turning bars.

The article by Wolfgang Walenski "Der Falzaufbau (Überbau)", or [Folding Structure (Superstructure], in "Der Rollenoffsetdruck", or [Web-Fed Offset Printing], 1st. ed., Fellbach Fachschriften, publishers, 1995, pages 186 to 197, discloses different methods of web guidance to formers by the use of turning bars. For example, on page 194 of the article it is shown to cut a web into two partial webs, to place these partial webs on top of each other and to conduct them centered to a former.

U.S. Pat. No. 3,734,487 discloses displaceable turning bars.

DE 101 31 976 A1 discloses printing presses for variable web widths with a straight path of the webs and with several formers side-by-side.

SUMMARY OF THE INVENTION

The object of the present invention is directed to providing a printing press with at least one printing group, one folding apparatus and at least one turning and mixing stage.

In accordance with the present invention, this object is attained by the provision of at least one printing group, one folding apparatus with a former and at least one turning and mixing stage. A web is conducted from the printing group to the folding apparatus in a path that has a bend or turn, in a horizontal plane projection, at the turning and mixing stage. A longitudinal cutting device is provided at the input to the turning and mixing stage and cuts the web longitudinally into at least two partial webs. Each of the partial webs then is directed to its own one of at least two turning bars which can be shifted horizontally.

Among the advantages of the printing press in accordance with the present invention is its simple, compact construction, which makes it possible to divide an imprinted web into two partial webs, and to place these two partial webs exactly on top of each other in a simple manner, and regardless of their width.

This advantage is achieved essentially because the turning and mixing stage of the printing press laterally bends the path of the web, as projected into a horizontal plane, from the printing group to the folding apparatus with the aid of two turning or deflection bars, around each of which turning or deflection bar a partial web can be looped. The turning and mixing stage has a longitudinal cutting device for use in forming the at least two partial webs from an imprinted web fed to the turning and mixing stage. These two turning or deflection bars can each be horizontally shifted.

In principle, these two deflection bars can be displaced in any arbitrary direction, which direction is not parallel in relation to their axes, in order to fix the position at which the partial webs exit from the turning and mixing stage. However, a displaceability which is parallel, in relation to the path of the web between the printing group and the turning and mixing stage, is preferred. With such an arrangement, the area of a turning or a deflection bar, around which the partial web loops, is not changed if the bar is shifted. A range of the displaceability of the webs or partial webs running from the turning and mixing stage to the folding apparatus is only limited by the freedom of movement of the turning or deflection bars.

If it is assumed that each web, which is processed in the printing press, is longitudinally cut and that the resulting partial webs are placed on top of each other prior to entering the folding apparatus, or if it is assumed that webs which exceed a fixed width limit are always cut, while webs of a greater width can also remain uncut, it is possible to save space and expense if the folding apparatus is constructed to be narrower than the printing stage. More exactly stated, space and expense can be saved if an inlet of the folding apparatus, which is not required to process webs of the full width which can be processed by the printing press, is narrower than an outlet of the printing group.

The printing group preferably is double-wide, and the folding apparatus is only configured for processing single-width webs.

To reroute a web, or to reroute the partial webs cut from that web, the turning and mixing stage has two or three turning or deflection bars. Since it is not necessary to be able to shift one of the turning or deflection bars over the other, all of the turning or deflection bars can be conducted along a common guide rail. At least one turning or deflection bar has the necessary length required for rerouting a web of maximal width. Every other turning or deflection bar can then be shorter than the one bar with the maximal length.

Because of the displaceability of the turning bars, every web fed to the folding apparatus has considerable freedom of movement in the transverse direction. Accordingly, movement of the former is not necessary to achieve a correct alignment of the web or of the partial webs on the former.

A second longitudinal cutting device, for use in longitudinally cutting a partial web, is preferably arranged in such a way at the turning and mixing stage on the conveying track of the web downstream of a turning or deflection bar that it acts on a partial web which was rerouted by the turning or deflection bar. This second cutting device is usefully centered on the former, so that its cutting line coincides with the nose of the folding cylinder. Since the web fed to the second longitudinal cutting device can be transversely shifted with the aid of the turning or deflection bar and can therefore always be fed to this second longitudinal cutting device exactly centered, regardless of its width, a displaceability of this second longitudinal cutting device is also unnecessary.

A turning bar is preferably arranged at a side of the turning and mixing stage which is facing away from the folding apparatus. Since, with a web which is guided around only one turning or deflection bar, the top and undersides are exchanged, in the course of passing through the turning and mixing stage, it is possible, by also looping the web around the turning bar, to conduct the web through the turning and mixing stage without exchanging the top and undersides.

If several turning and mixing stages are simultaneously arranged on top of each other for processing several webs, such a turning bar can also be used for exchanging webs between the turning and mixing stages.

The second longitudinal cutting device can be arranged along the path of travel of a web from one turning and mixing stage to another turning and mixing stage. The two partial webs, formed by this longitudinal cutting device, can be conducted to respectively different turning and mixing stages. It is also possible to place the second longitudinal cutting device directly at the outlet of the turning and mixing stage. This is particularly useful for printing tabloid products.

If the printing press contains more than two printing groups, the turning and mixing stage is preferably arranged between the two. Webs can be fed to the turning and mixing stage selectively from both sides.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
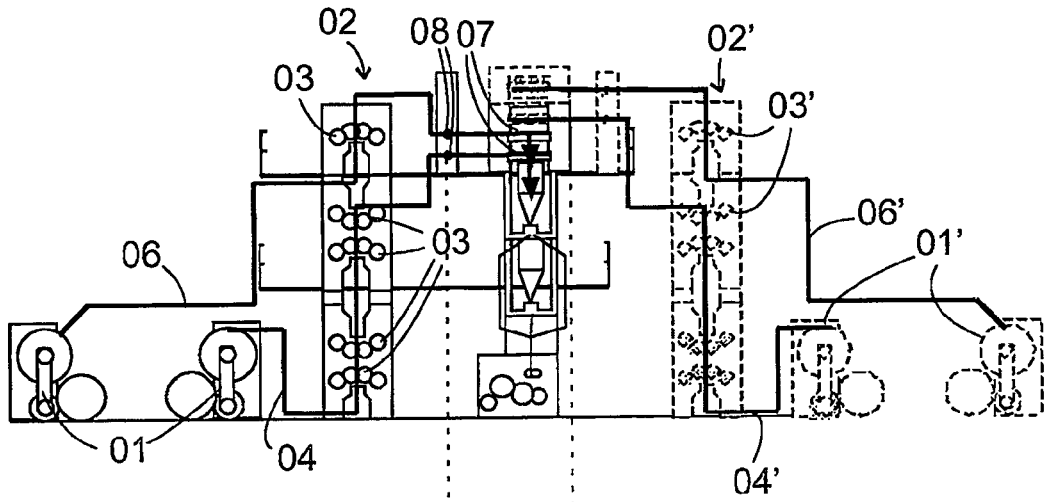
FIG. 1, a schematic side elevation view of a printing press in accordance with the present invention, in FIG. 2, a top plan view of the printing press in accordance with FIG. 1, in FIG. 3, a schematic representation of two turning and mixing stages of the printing press, in FIGS. 4 to 6, examples of paths of web guidance in the turning and mixing stages, and in FIGS. 7 to 9, schematic depictions of different ways of cutting and of folding a paper web in the press in accordance with the present invention.

A schematic side elevation view of a printing press in accordance with the present invention is shown in FIG. 1. Two roll changers 01 are arranged for use with a printing tower 02 includes five printing groups 03 which are adapted for imprinting both sides of a web 04 or 06 passed through them. The webs 04 and 06, which are wound off two the roll changers 01, can be conducted to the printing tower 02 on different paths, as seen in FIG. 1. A configuration is shown in FIG. 1 wherein the web 04 passes through the lower four printing groups 03 and is imprinted in color. The web 06 is imprinted in black and white in the upper printing group 03. It is, of course, possible to provide configurations wherein one of the webs 04, 06 passes through two printing groups and the other web passes through three printing groups, etc.

The webs 04, 06, which are imprinted in the printing tower 02, are each respectively conducted to one of two turning and mixing stages 07, which are arranged on top of each other, as seen in FIG. 1. As shown in the view from above in FIG. 2, these two stages 07 are arranged in a straight line with the roll changers 01 and the printing tower 02.

Figure 2:
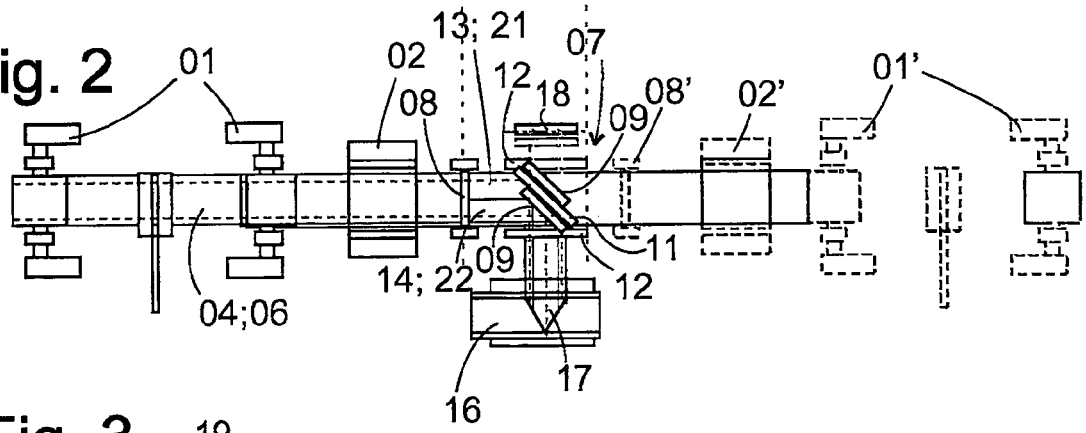

In the extension of this straight line, it is possible to arrange a further printing tower 02' and further roll changers 01', which are represented in dashed lines in FIGS. 1 and 2, for its supply. Webs 04', 06' imprinted in this further printing tower 02' are also conducted to turning and mixing stages, which constitute a stack with the stages 07.

A longitudinal cutting device 08, such as, for example, in the form of two traction rollers which rotate in contact with each other, between which respective webs 04, 06 are passed and on one of which there is situated a rotating blade, is located between the printing tower 02 and the turning and mixing stage 07. If required, the longitudinal cutting device 08 can be moved away from the webs 04, 06, so that it lets the webs 04, 06 to pass through the longitudinal cutting device 08 uncut.

Each turning and mixing stage 07 contains three turning or deflection bars 09, 11, which are arranged at an angle of 45° with respect to the transport direction of the web 04, 06. The length of the center turning or deflection bar 11 is of such dimensions that it is able to reroute a web 04, 06, of a maximum web width which can be processed in the printing tower 02 by 90°. The two outer turning or deflection bars 09 each have a lesser width, which is selected for rerouting a partial web 13, 14, 21, 22 which is formed at the longitudinal cutting device 08. The turning or deflection bars 09, 11 can be shifted independently of each other in horizontal rails 12, which are aligned with the straight line connecting the roll changers 01, printing tower 92 and turning and mixing stage 07. The web 04 or 06 leaves the turning and mixing stage 07 after having been turned by 90°. The two short turning or deflection bars 09 are each placed in such a way that partial webs 13, 14, 21, 22, which were formed at the longitudinal cuffing device 08, come to rest exactly on top of each other at the outlet of the turning and mixing stage 07. This is possible independently of the width of the supplied web 04, 06, since the turning or deflection bars 09 can be shifted with respect to each other. It is also possible, by shifting the turning or deflection bars 09 or 11 to align the web 04, 06 or the partial webs 13, 14, 21, 22 exiting the turning and mixing stage 07 exactly with respect to the former 17 of a folding apparatus 16 and to fold the webs or partial webs linearly in the center of the webs or the partial webs in this way.

The turning bars 09, 11 can be pivoted around a vertical axis by 90°, and can be turned around a horizontal axis, which is parallel, in relation to the web transport direction, by 180°, in order to initially guide a web 04, 06 or partial webs 13, 14, 21, 22, which are looped around them, to a second turning bar 18, where they are turned by 180° and are finally conducted to the former 17. A longitudinal axis of the inlet of the former 17 is arranged at 90° with respect to the longitudinal axis of a cylinder of the printing group 03.

Figure 3:
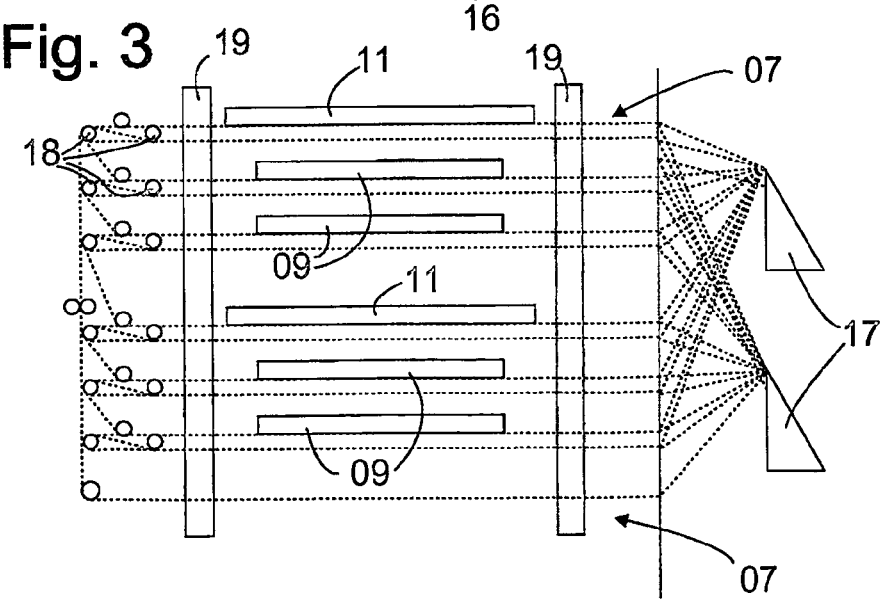

The second turning bars 18 are also used for interchanging partial webs 13, 14, 21, 22 between different turning and mixing stages 07, as will become clear from a review of FIGS. 3 to 6. FIG. 3 shows a schematic side elevation view of two turning and mixing stages 07, which are located one above the other, and each of which is provided with two short turning or deflection bars 09 and one long turning or deflection bar 11, which bars 09, 11 are maintained in frame elements 19. Two triangles, shown in FIG. 3, symbolize two formers 17, which two formers 17 are located one above the other, and are part of the folding apparatus 16. Located opposite these former 17, several groups of second turning bars 18 are arranged, three such second turning bars 18 are assigned to each turning or deflection bar 09, 11. Dashed lines symbolize possible web paths.

Figure 4:
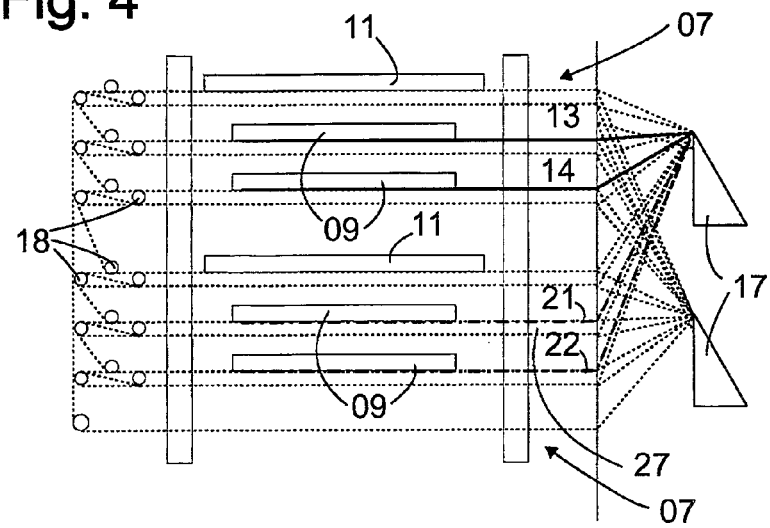
Figure 5:
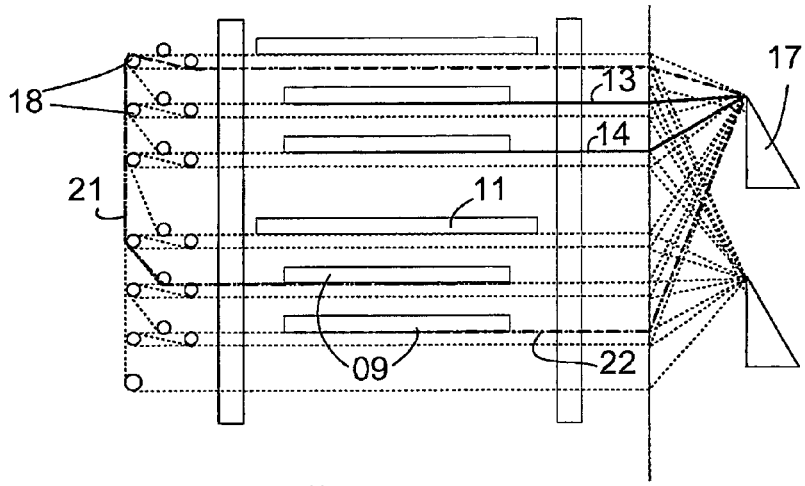
Figure 6:
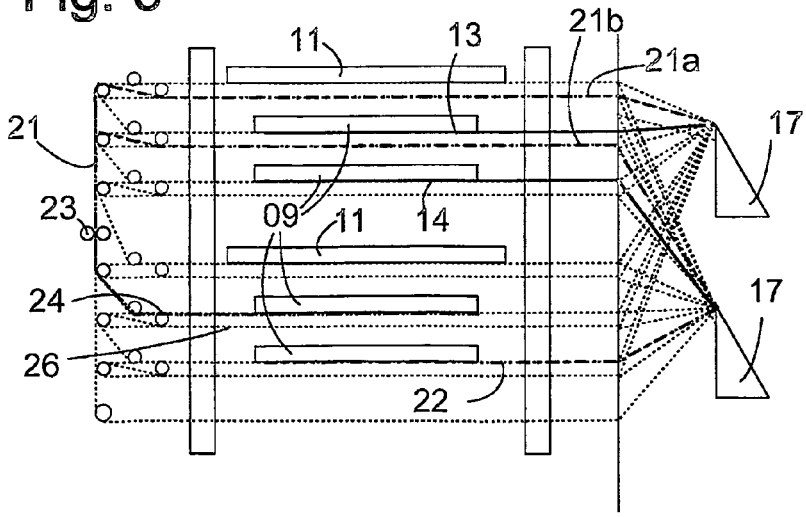

Concrete examples for web paths, in accordance with the present invention, are represented in FIGS. 4 to 6. FIG. 4 shows a simple example, wherein two partial webs 13, 14, which are formed from the web 06, are rerouted in the upper turning and mixing stage 07, and two partial webs 21, 22, which are formed from the web 04, are rerouted in the lower turning and mixing stage 07, and are conducted directly to the upper former 17 while maintaining their sequence. It is, of course, also possible to conduct one or several lower of the partial webs 21, 22, or all of the partial webs 13, 14, 21, 22 to the lower former 17.

With the configuration shown in FIG. 5, the partial web 21 is conducted over the second turning bars 18 into the upper turning and mixing stage 07, and is conducted from there as the uppermost web 21 to the former 17. A printed product is obtained in this way, whose outermost and innermost page each are of a different color than those of the two pages lying between them. It would, of course, also be possible to feed the partial web 21 to the former 17 between the partial webs 13 and 14. In the same way, it would be possible to exchange each other partial web 13, 14, 21, 22 between the turning and mixing stages 07. Alternatively, several partial webs 13, 14, 21, 22 could be simultaneously exchanged.

A longitudinal cutting device 23, which is, as seen in FIG. 6, arranged at the second turning bars 18, allows the separation of a partial web 13, 14, 21, 22 along the partial web center, and in the case shown in FIG. 6, the partial web 21, into two half-width partial webs 21*a*, 21*b*. In the configuration represented here, each of the two half-width partial webs 21*a*, 21*b* results in a single inner page in the continuous webs fed to the two formers 17. The longitudinal cutting device 23, shown in FIG. 6, is arranged at a location in which it can act on a partial web 21 which is exchanged between the turning and mixing stages 07. It would also be within the scope of the present invention to assign a longitudinal cutting device 23 to each such partial web 13, 14 21, 22, and in the case of the partial web 21 at, for example, the spot indicated by 24. With this, the possibility would be provided of conducting one of the two partial webs 21*a*, 21*b* to the former 17 along the path indicated by 26. The placement of a longitudinal cutting device 23 would also be conceivable respectively on a direct path between a turning bar 09 and the formers 17, in the case of the partial web 21, perhaps at the location identified by 27 in FIG. 4, in order to conduct the resulting partial webs respectively to one or to different formers 17.

Figure 7:
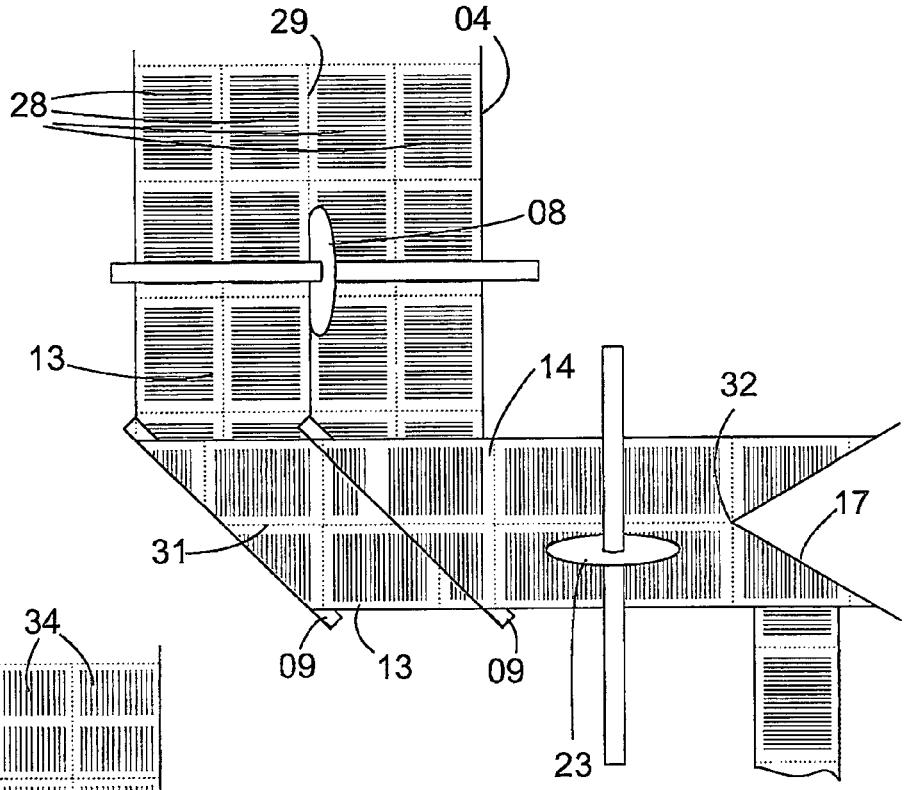

Depending on the width of webs 04, 06 being used, a large diversity of production options results. FIG. 7 shows a newspaper production in broadsheet format. The plate cylinders of the double-width printing groups 03 shown in FIG. 1 each support four plates side-by-side, and each prints a web 04 with four pages 28, each with horizontal lines, located side-by-side, as shown in FIG. 7.

Figure 8:
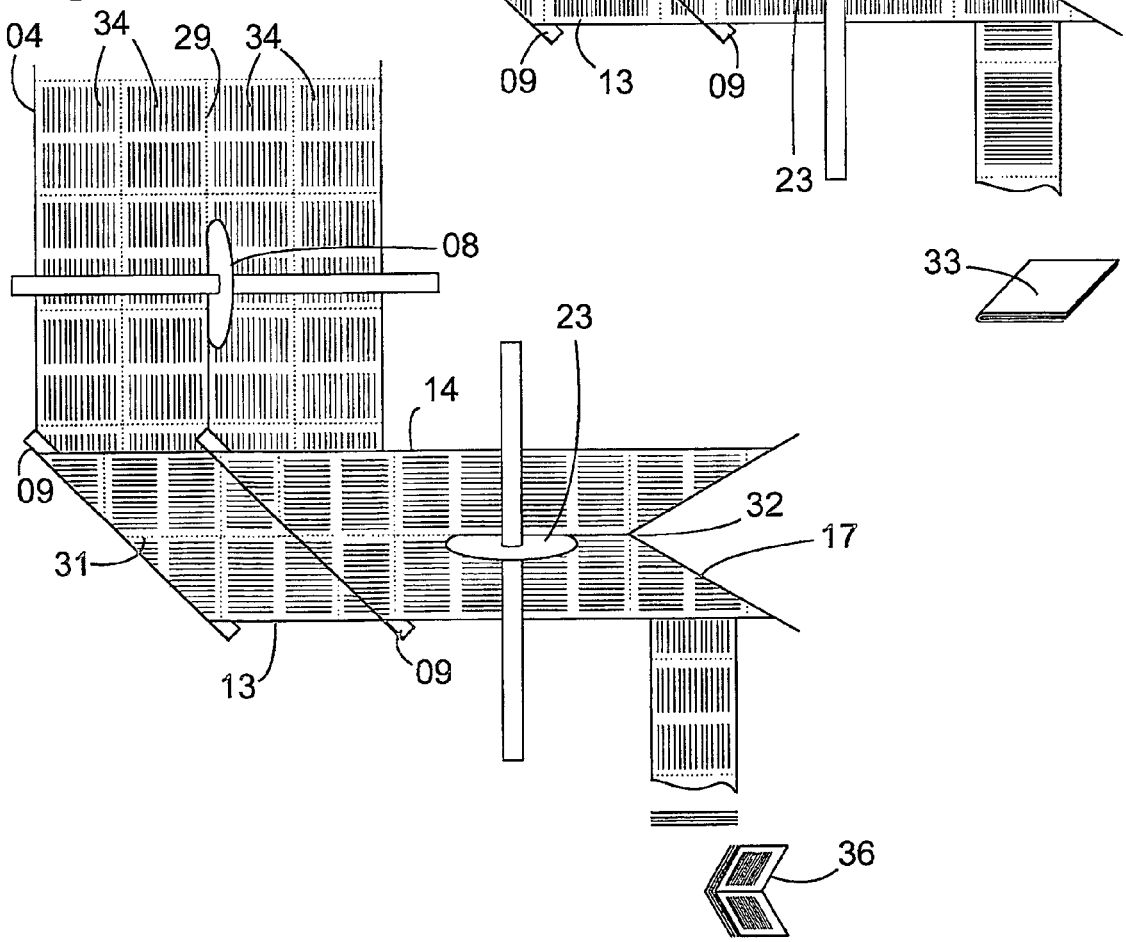

The imprinted web 04 is separated into two partial webs 13, 14 in the longitudinal cutting device 08. The longitudinal cutting device 08 need not be displaceable transversely, in relation to the web 04, because even if various webs 04 of different widths are employed, they are always conducted through the printing group 03 centered, so that the boundary line between the second and third pages formed on the web 04 always exactly meets the cutter of the longitudinal cutting device 08. By displacing the turning or deflection bars 09, in the feed direction of the web 04, or in the vertical direction as shown in FIGS. 7 and 8 of the drawing figure, the partial webs 13, 14 which are rerouted at the turning or deflection bars 09 can be exactly aligned in such a way that the boundary line 31 between the two sides of each of the partial webs 13, 14 exactly meets the nose 32 of the former 17, so that a longitudinal fold is created in this boundary line 31. A signature 33, which is obtained by separating the folded partial webs 13, 14, contains eight pages on two sheets lying inside each other. Different numbers of pages can, of course, be achieved by admixing additional partial webs 21, 22 in the former 17. By shifting the turning or deflection bars 09, it is always possible to align the boundary lines 31 of the partial webs 13,14 with the former nose 32, regardless of the width of the partial webs 13, 14. No lateral displaceability is required either for the former 17. Therefore, webs 04, 06 of different widths can be easily processed.

FIG. 8 shows the processing of a web 04 which has been imprinted in tabloid format. As shown in FIG. 8, respectively four double pages 34, each with a vertical orientation of the lines, are imprinted side-by-side. In the same way as described with respect to FIG. 7, the web 04 is cut along the boundary line 29 by the longitudinal cutting device 08, and the resulting partial webs 13, 14 are placed on top of each other with the aid of the turning or deflection bars 09. A further longitudinal cutting device 23 separates each of the several partial webs 13, 14 along the boundary line 31, so that the four resulting partial webs are simply placed on top of each other in the former 17. Separating, and transverse folding now results in the finished signature 36, which finished signature 36 here has sixteen pages on four sheets, but whose number of pages could be doubled by the initiation of a collecting operation during transverse folding, or which could be increased by admixing additional partial webs.

Figure 9:
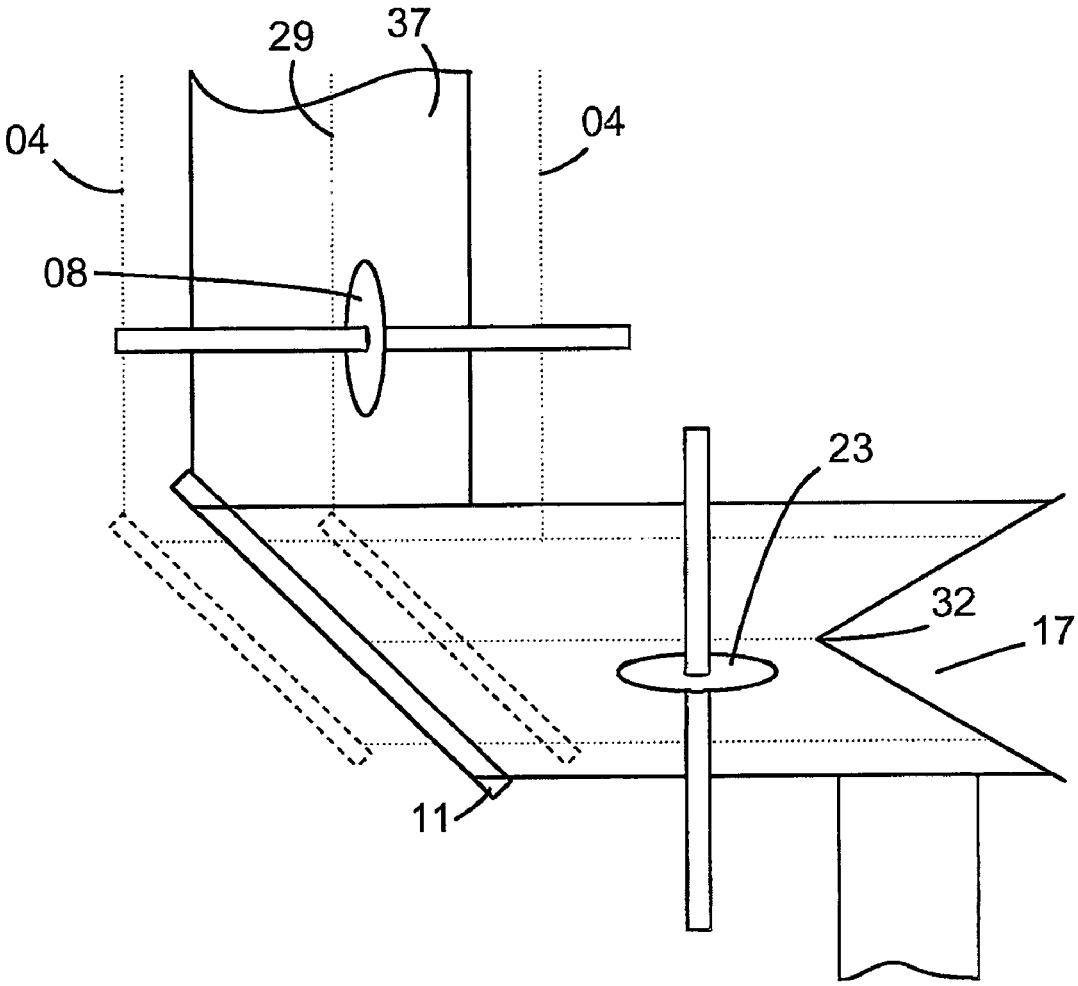

FIG. 9 represents the operation of the press in accordance with the present invention during its use for job printing. The web 37 used for this job printing is narrower than the web 04 which is typically used for newspaper printing and which is considered in FIGS. 7 and 8, and whose edges are represented by dotted lines in FIG. 9. The longitudinal cutting device 08 has been moved away from the web 37, and the web 37 is deflected, without having been cut, at the long turning or deflection roller 11, is now directed toward the former 17, and is folded in the latter.

Processing operations, with longitudinal cutting as shown in FIGS. 7 and 8, would, of course, also be possible in connection with job printing, again depending on the width of the web 37 and the page format of the finished product.

In connection with printing presses with at least one double-width printing group 03 and with a former 17, the former 17, which is employed, is wider than half the width of the printing group 03, or is wider than the effective printing surface of the cylinders. Double-width means that the printing group 03 has at least a width of four newspaper pages.

In another embodiment, in one mode of operation a web 04, 06, which is more than of single width, such as, for example a web 04, 06 of a width of more than two newspaper pages, but which is narrower than a double-width web 04, 06, is arranged centered in the printing group 03. In this case, the printing group 03 imprints the web 04, 06 with two newspaper pages. In another mode of operation, a longitudinal cutting device 08 has been arranged in such a way that it halves a double-wide web 04, 06, such as a web 04, 06 having four newspaper pages, and the two partial webs 13, 14, 21, 22 being formed are arranged on the former 17.

While preferred embodiments of a printing machine comprising at least one printing group, one folder and at least one turn-and-mix stage, in accordance with the present invention, are set forth fully and completely hereinabove, it will be apparent to one of skill in the art that various changes in, for example, the specific structure of the printing groups, the types of roll changers used to support the webs, and the like could be made without departing from the true spirit and scope of the present invention which is accordingly to be limited only by the appended claims.

What is claimed is:

1. A printing press comprising:

at least one printing group having at least one printing cylinder with an effective printing surface width;

at least one folding apparatus adapted to receive a printed web from said at least one printing group;

a former in said at least one folding apparatus and having a former width greater than half of said effective printing surface width of said at least one printing cylinder, said former including a former nose;

at least one turning and mixing stage, interposed, in a path of travel of the printed web from said at least one printing group, said at least one turning and mixing stage being positioned between said at least one printing group and said at least one folding apparatus, said path of travel of the printed web, when projected into a horizontal plane, having a bend in said turning and mixing stage;

a first longitudinal web cuffing device at an input side of said turning and mixing stage and adapted to cut the printed web into first and second partial webs having first and second partial web widths different from each other;

at least first and second shiftable turning bars in said at least one turning and mixing stage, each of said first and second partial webs being looped around a respective one of said at least first and second turning bars, means supporting each of said at least first and second turning bars for movement in said path of travel of the printed web to center each of said first and second partial webs of said first and second different partial web widths on said former nose; and a second longitudinal web culling device at an output side of said turning and mixing stage, said second longitudinal web cutting device being centered on said former nose.

2. The printing press of claim 1 wherein said at least one printing group is a double wide printing group having a width of at least four newspaper pages.

3. The printing press of claim 1 further including at least a third turning bar, each of said first, second and third turning bars being arranged at an angle of 45° with respect to said direction of web travel, a center one of said first, second and third turning bars having a first length adapted to deflect a web of a maximal width which can be processed by said at least one printing group, said outer ones of said first, second and third turning bars having a second length less than said first length.

4. The printing press of claim 1 wherein said at least first and second turning bars are parallel to each other in said path of web travel between said printing groups and said turning and mixing stage.

5. The printing press of claim 1 wherein said printing group has an outlet of a first width and said folding apparatus has an inlet of a second width, said printing group outlet width being greater than said folding apparatus inlet width.

6. The printing press of claim 1 wherein said printing group is double wide and said folding apparatus is adapted to process single-width webs.

7. The printing press of claim 1 wherein said turning and mixing stage has first, second and third turning bars arranged on one level.

8. The printing press of claim 1 wherein said former is fixed in place.

9. The printing press of claim 1 further including a third turning bar attached to a side of said turning and mixing stage and facing away from said folding apparatus.

10. The printing press of claim 1 further including at least a second turning and mixing stage situated at a level different from a level of said at least one turning and mixing stage.

11. The printing press of claim 10 wherein a web can be conducted from said at least one turning and mixing stage to said second turning and mixing stage using said turning bars.

12. The printing press of claim 10 wherein a third longitudinal web cutting device is arranged on a path between said at least one turning and mixing stage and said second turning and mixing stage.

13. The printing press of claim 12 wherein said third longitudinal cutting device is fixed in place transversely with respect to said web and is centered with respect to said former.

14. The printing press of claim 1 further including a second printing group and wherein said at least one turning and mixing stage is positioned between said one printing group and said second printing group.

15. The printing press of claim 1 wherein said at least one printing group is adapted for printing a web with two newspapers pages.

* * * * *

UNITED STATES PATENT AND TRADEMARK OFFICE

CERTIFICATE OF CORRECTION

PATENT NO. : 7,513,195 B2
APPLICATION NO. : 10/543256
DATED : April 7, 2009
INVENTOR(S) : Günther Oskar Eckert and Burkard Otto Herbert It is certified that error appears in the above-identified patent and that said Letters Patent is hereby corrected as shown below:

Column 8, Claim 1, Line 26, after “web”, change “cuffing” to -- cutting --; and
Column 8, Claim 1, Line 40, after “web”, change “culling” to -- cutting --.

Signed and Sealed this

Fourteenth Day of July, 2009

John Doll

JOHN DOLL
*Acting Director of the United States Patent and Trademark Office*